US005303693A

United States Patent [19]

Schroeter et al.

[11] Patent Number: 5,303,693

[45] Date of Patent: Apr. 19, 1994

[54] SUMMER DAMPER FOR FIREPLACE

[75] Inventors: Wolfgang Schroeter, Midhurst; Clifford Lilley, Anten Mills, both of Canada

[73] Assignee: Wolf Steel Ltd., Barrie, Canada

[21] Appl. No.: 977,454

[22] Filed: Nov. 17, 1992

[30] Foreign Application Priority Data

Nov. 13, 1992 [CA] Canada ..... 2082915

[51] Int. Cl.[5] ..... F24B 1/189

[52] U.S. Cl. ..... 126/522; 126/536; 126/512

[58] Field of Search ..... 126/289, 522, 523, 536, 126/535, 512, 531, 524, 530, 515, 524, 518

[56] References Cited

U.S. PATENT DOCUMENTS

| | | | |
|---|---|---|---|
| 2,789,554 | 4/1957 | Duper | 126/524 X |
| 4,042,160 | 8/1977 | Ickes | 126/524 |
| 4,224,921 | 9/3080 | Petreseue . | |
| 4,230,092 | 10/1980 | Henriques | 126/530 X |
| 4,280,473 | 7/1981 | Hempel . | |
| 4,377,153 | 3/1983 | Flagg | 126/518 |
| 4,404,954 | 9/1983 | Steel | 126/531 X |
| 4,545,360 | 10/1985 | Smith et al. . | |
| 4,738,241 | 4/1988 | Bernelov et al. | 126/526 X |
| 4,971,030 | 11/1990 | Thow et al. | 126/523 X |
| 5,014,683 | 5/1991 | Wilkening | 126/515 |

OTHER PUBLICATIONS

The Cannon "Live-Fire", Cannon Industries Limited (no date).

*Primary Examiner*—Larry Jones
*Attorney, Agent, or Firm*—Kvas Miller

[57] ABSTRACT

A fireplace comprises a firebox having a top panel, bottom panel, rear panel and a flue. An outer casing is spaced from and surrounds the firebox. A combustion air feed passage for supplying combustion air to the firebox is provided. A heat exchanger, which is located downstream from the flue for receiving the combustion gases and for transmitting the heat from the combustion gases to air to be heated, is also provided. The fireplace includes a passage for conveying the combustion gases from the flue to a conduit in communication with a source external to the room in which the fireplace is situated for exhausting the combustion gases from the fireplace and a switch for selectively coupling the heat exchanger in series with the passage. The switch is operable between a first position which the flue gases pass through the heat exchanger before being vented to the outside and a second position which the flue gases pass through the passage, bypassing the heat exchanger, and are then vented to the outside. A second passage is provided between the outer casing and the firebox for circulation of air to be heated along with the heat exchanger.

20 Claims, 10 Drawing Sheets

SUMMER DAMPER FOR FIREPLACE

FIELD OF THE INVENTION

This invention relates to fireplaces. In a preferred embodiment, the invention relates to a balanced flue, zero clearance fireplace or to a fireplace insert or to a free-standing fireplace.

BACKGROUND TO THE INVENTION

Various types of fireplaces are known in the art. One traditional type of fireplace is a masonry fireplace which is built into a room of a house or other dwelling unit. Such a fireplace has a masonry firebox and a masonry chimney extending upwardly to vent above the roof of a house. While these fireplaces may be decorative, their heating efficiency is very low. Further, these fireplaces are necessarily fixed in place and require that a room be decorated around the location of the fireplace.

One way to solve this problem has been to use a zero clearance fireplace. Such fireplaces may be positioned at any desired location in a room. Various designs for such fireplaces have been developed. Some of these fireplaces are designed to be energy efficient, i.e. to transfer some of the heating value of the fuel consumed in the fireplace to the room in which the fireplace is situated.

Such fireplaces are also used for their decorative value. However, due to the heat generated by their use, high efficiency fireplaces may only be utilized in the winter when they are used for their supplemental heating value.

BRIEF DESCRIPTION OF THE INVENTION

It has now been found that this disadvantage may be overcome by using a fireplace comprising a firebox having a bottom panel, a top panel, a rear panel and a flue; an outer casing having a top panel and a rear panel, the casing being spaced from and surrounding the firebox; combustion air feed means for supplying combustion air to the firebox; a heat exchanger located downstream from the flue for selectively receiving combustion gases and for transmitting the heat from the combustion gases to the air to be heated; first passage means for conveying the combustion gases from the flue to a conduit means in communication with a source external to the room in which the fireplace is situated for exhausting the combustion gases from the fireplace; switching means for selectively coupling the heat exchanger in series with the first passage means, the switching means being operable between a first position in which the combustion gases pass through the heat exchanger before being vented to the outside and a second position in which the combustion gases pass through the first passage means, by-passing the heat exchanger, and are vented to the outside; and second passage means positioned between the outer casing and the firebox for circulation of the air to be heated along the heat exchanger.

The particular design may be used either with a free-standing fireplace, a zero clearance fireplace or with a fireplace insert which is designed to be installed in a preexisting solid fuel burning masonry fireplace. For the purpose of this disclosure, "fireplace" is used to refer to both a free-standing fireplace as well as a fireplace insert. In addition, the fireplace may either consume a solid organic fuel such as wood, or alternately a gaseous fuel such as natural gas or propane.

Fireplaces according to the instant design may be highly decorative and may be used at any time during the year. When the fireplace has a sealed combustion chamber, which may occur if the firebox has a door which is closed, then the amount of heating value from the combustion gases which is transmitted to the room may be controlled by limiting, or preventing, the combustion gases from passing through the heat exchanger. Accordingly, the fireplace may be used for decorative value on a summer evening without excessive heat being transmitted to the room in which the fireplace is situated.

The substance and advantages of the present invention will be more fully and completely described in accordance with the following description, and the accompanying drawings, for a preferred embodiment of the invention.

DETAILED DESCRIPTION OF THE PREFERRED EMBODIMENT

Figure 1:
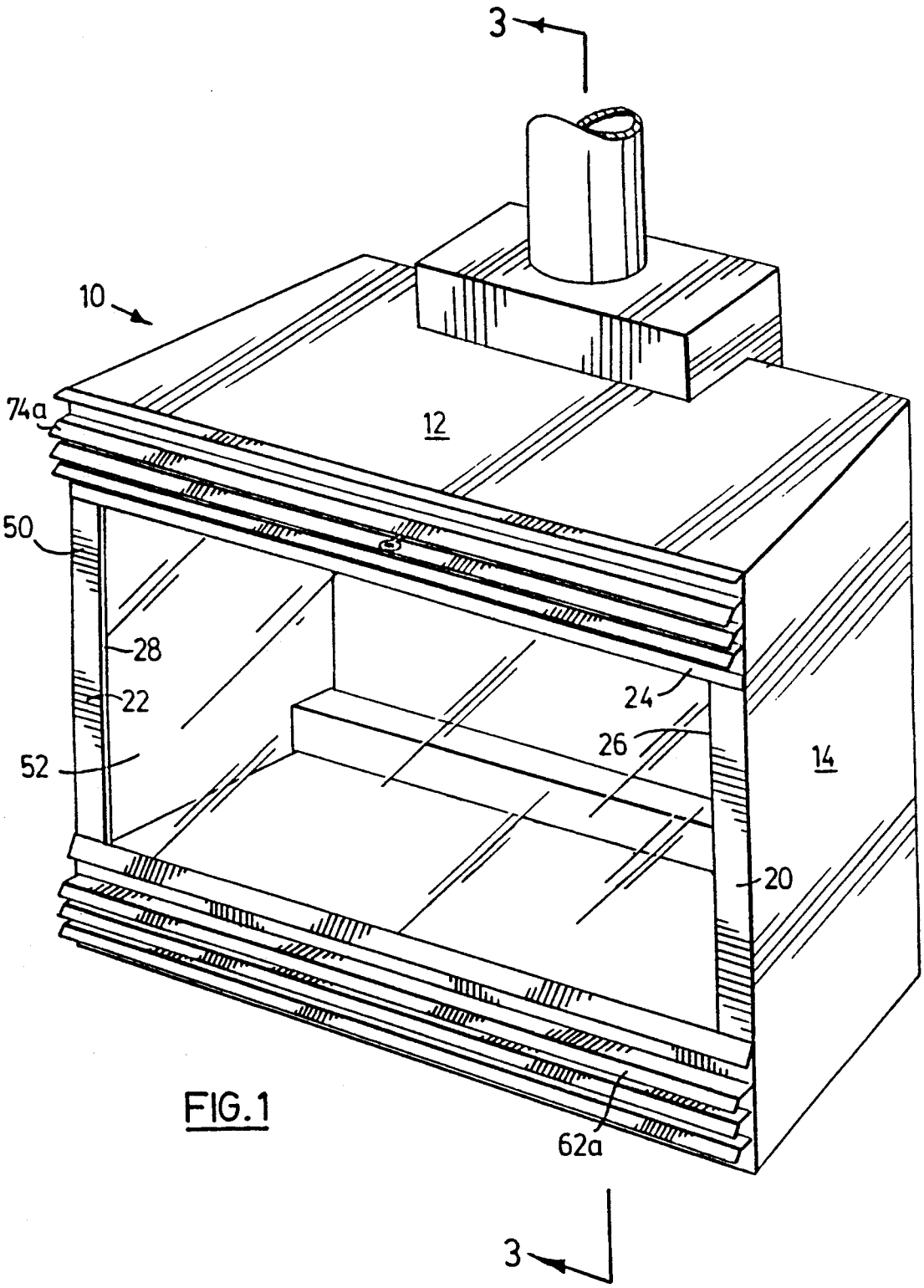
FIG. 1 is a front perspective view of the fireplace according to the invention.
Figure 2:
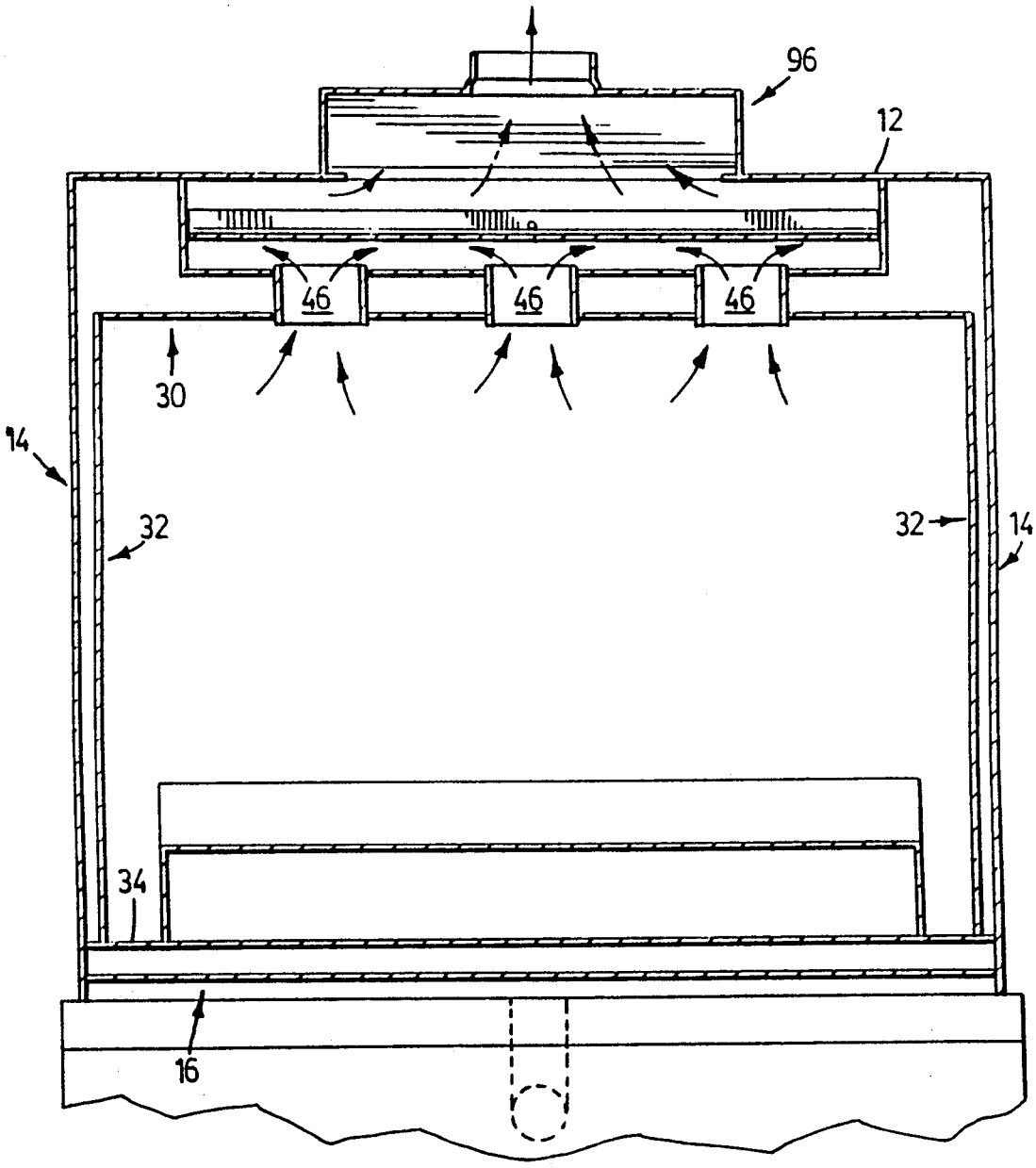
FIG. 2 is a cross-section along the line 2—2 in FIG. 3.
Figure 3:
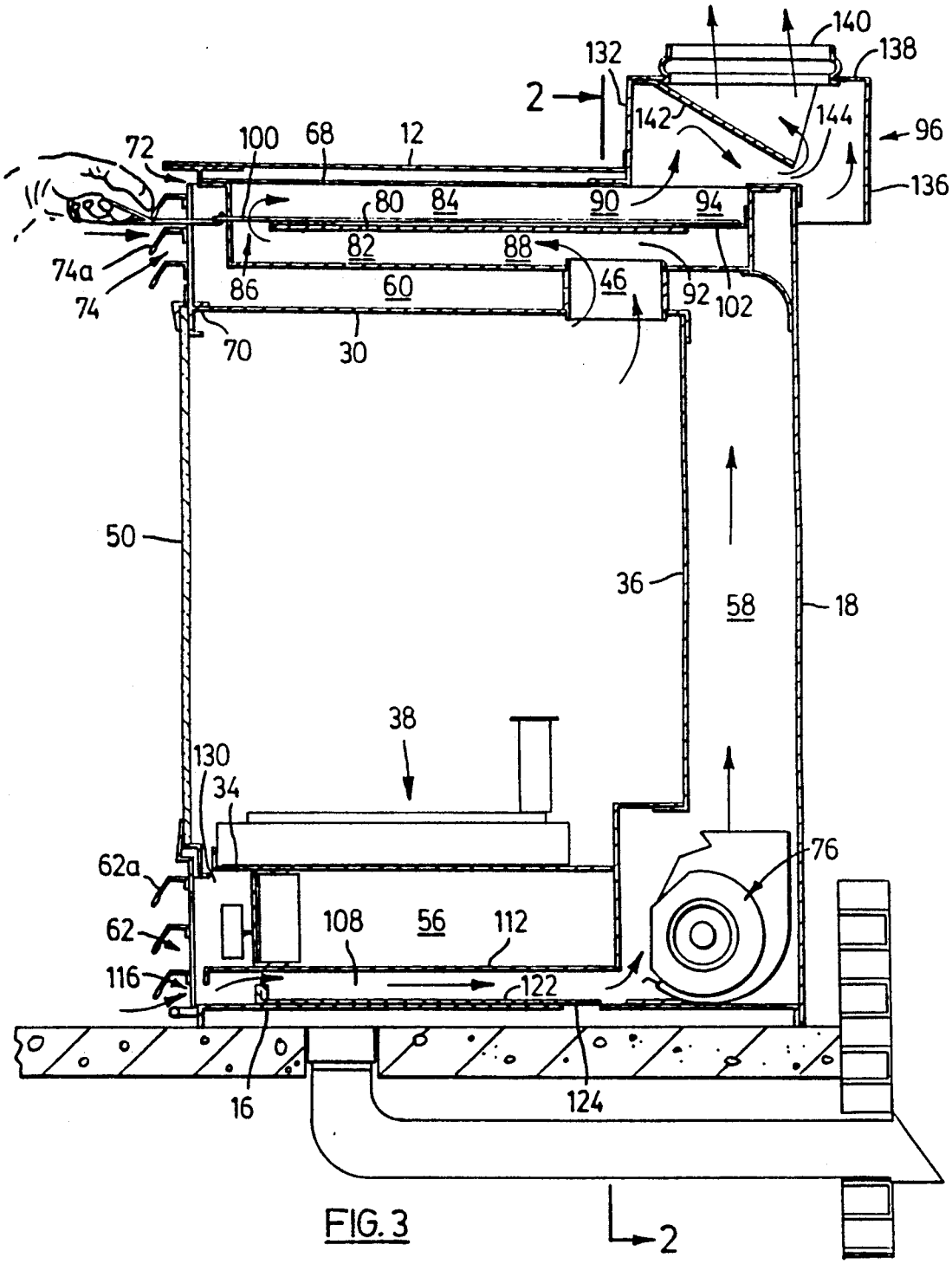
FIG. 3 is a cross-section along the line 3—3 in FIG. 1 with both the by-pass and the fresh air dampers closed.

As shown in FIGS. 1, 2 and 3, fireplace 10 has a top casing panel 12, two side casing panels 14, a bottom casing panel 16, and a rear casing panel 18. Top casing panel 12, side casing panels 14, bottom casing panel 16 and rear casing panel 18 define the top, sides, bottom and rear respectively of fireplace 10.

Fireplace 10 also has right front casing panel 20, left front casing panel 22 and upper front casing panel 24. These panels are positioned at the side and top periphery of the front of the fireplace. The inside edge of right front casing panel 20 is designated by reference numeral 26 and the inside edge of left front casing panel 22 is designated by reference numeral 28.

Positioned inside the outer casing of the fireplace is a firebox. The firebox is defined by top panel 30, right and left side panels 32, bottom panel 34 and rear panel 36. While the firebox is shown as being rectangular in the attached drawings, the firebox may be of any desired shape. The outer casing is positioned so as to be spaced from and so as to surround the firebox.

If the fireplace is designed for burning a solid organic fuel such as wood, then a grate or other holding means may be provided on bottom panel 34. Alternately, if the fireplace is to be used to burn a gaseous fuel, such as natural gas or propane, then a burner unit may be provided. As shown in FIG. 3, a burner 38 may be provided in the lower portion of the firebox. As is known in the art, the gaseous fuel may be supplied to the firebox through a pipe (not shown) positioned underneath the firebox. The pipe connects with a regulator (not shown) . The gaseous fuel passes from the regulator to burner 38 via a pipe (not shown). The burner unit may also be supplied with an igniter and a flame detector (not shown).

Flue 46 is provided for exhausting the combustion gases from the firebox. Accordingly, flue 46 is provided at an upper portion of the firebox. In the preferred embodiment shown in FIGS. 3 and 4, the flue is provided in top panel 30 of the firebox and, in particular, flue 46 is centrally located in top panel 30 adjacent rear panel 36. Thus, the combustion gases will rise up through the firebox and enter flue 46. As is shown in FIG. 2, in the preferred embodiment three flues 46 are used to exhaust combustion gases from the firebox. Alternately, if the fireplace is to be rear vented, flue 46 may be centrally located in rear panel 36 adjacent top panel 30 (see FIGS. 6 and 7).

As discussed above, the fireplace may be equipped to burn either a solid organic fuel, such as wood, or a gaseous fuel, such as natural gas or propane. If a gaseous fuel is to be combusted in the fireplace, then government regulations typically require that the firebox be sealed. To this end, the firebox may be provided with door 50 (see FIG. 3). Door 50 may be affixed by any means known in the art to either the firebox itself or to the outer casing. Further, as shown in FIG. 1, door 50 may also have a transparent panel, such as a glass window 52 positioned centrally therein. Optionally, such transparent panels may be provided in more than one side of the firebox.

By positioning the outer casing so as to be spaced from and so as to surround the fireplace, a passage is provided for the circulation of air along the outside of the panels of the firebox. Generally, any source of air may be used for circulation through this air passage. Preferably, the air passage is in communication with the room in which the fireplace is situated and the room air is circulated around the fireplace.

Figure 4:
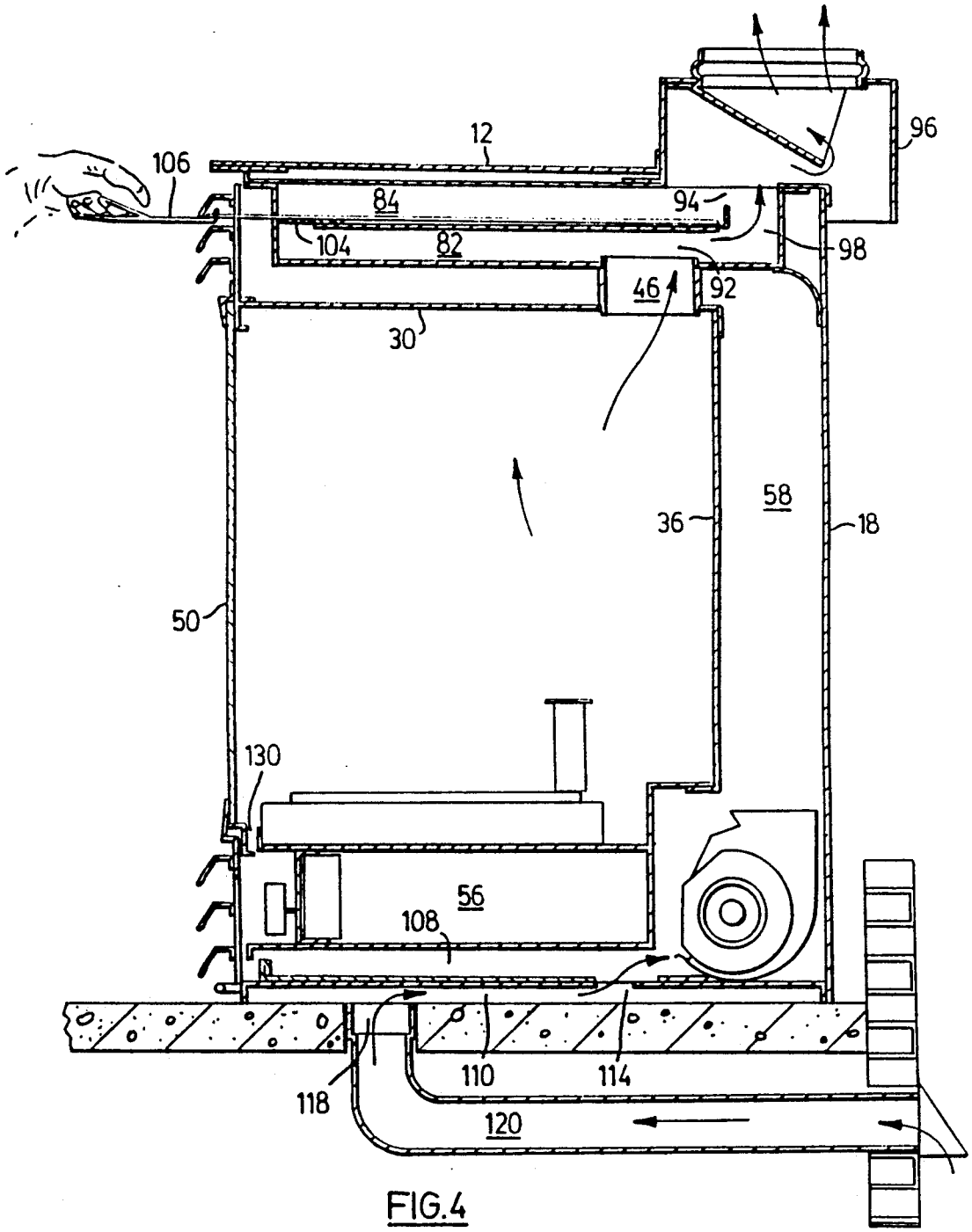
FIG. 4 is a cross-section similar to that shown in FIG. 3 but with both the by-pass and the fresh air dampers open.

As shown in FIGS. 3 and 4, the air passage may comprise lower room air plenum 108, rear room air plenum 58 and upper room air plenum 60.

Room air plenum 56 is positioned between bottom panel 34 of the firebox and bottom casing panel 16. Room air plenum 56 may extend substantially the entire width of the space below the firebox. Room air entry port 62 is located at the front portion of lower room air plenum 56 and is defined by inside edge 26 of right front casing panel 20, inside edge 28 of left front casing panel 22, the front portion of bottom casing panel 16 and the front portion of bottom panel 34 of the firebox. Grate **62*a* may be provided to cover room air entry pert 62**.

Lower room air plenum 108 is positioned below room air plenum 56 and is separated therefrom by lower room air plate 112. Lower room air plenum 108 may extend substantially the entire width of the space below the firebox. An entrance, generally designated by reference numeral 116 is provided at the forward portion of lower room air plenum 108. Once again, grate **62*a* may be provided to cover entrance 116**.

Rear room air plenum 58 is located between rear panel 36 of the firebox and the outer wall defined by rear casing panel 18. Rear room air plenum 58 may extend across the entire rear surface of the firebox. If the fireplace is to be a zero clearance fireplace, and if the temperature of rear casing panel 18 is greater than desired, then insulation may be provided along the rear wall of the fireplace. In such cases, the insulation may not be required to extend all the way to the bottom portion of the fireplace but may terminate at a position in the lower half of the fireplace.

Top room air panel 68 is positioned upwardly from top panel 30 of the firebox. Upper room air plenum 60 is located between top room air panel 68 and top panel 30 of the firebox. Once again, upper room air plenum 60 may extend substantially the entire width across the top of the firebox. As shown in FIG. 3, top panel 30 of the firebox has a front edge 70 and top room air panel 68 has a front edge 72. Room air exit port 74 is provided at the front portion of upper room air plenum 60 and is defined by inside edge 26 of right front casing panel 20, inside edge 28 of left front casing 22, front edge 70 of top panel 30 of the firebox and front edge 72 of top room air panel 68. Grate **74*a* may be provided to cover room air entry port 74**.

Accordingly, room air enters lower room air plenum 108 via room air entry port 62, travels along the bottom of the firebox and then up the rear of the firebox through rear room air plenum 58 and then across the top of the firebox through upper room air plenum 60 to exit the fireplace via room air exit port 74. As it travels along this path, the room air is heated by contact with the walls of the firebox. A blower may be provided to increase the flow of air through the room air plenums. Blower 76 may be positioned at any desired location in the room air plenums. As will be appreciated, once fireplace 10 is in operation, room air would be drawn via natural convection into room air entry port 62, through the room air plenums and out room air exit port 74. However, blower 76 could be oriented to reverse the natural direction of travel of the room air such that the room air would enter via the top of the unit, then travel downwardly along rear room air plenum 58 and out port 62. In the preferred embodiment, blower 76 is provided towards the rear of lower room air plenum 108 so as to enhance the natural convection of the room air.

Figure 5:
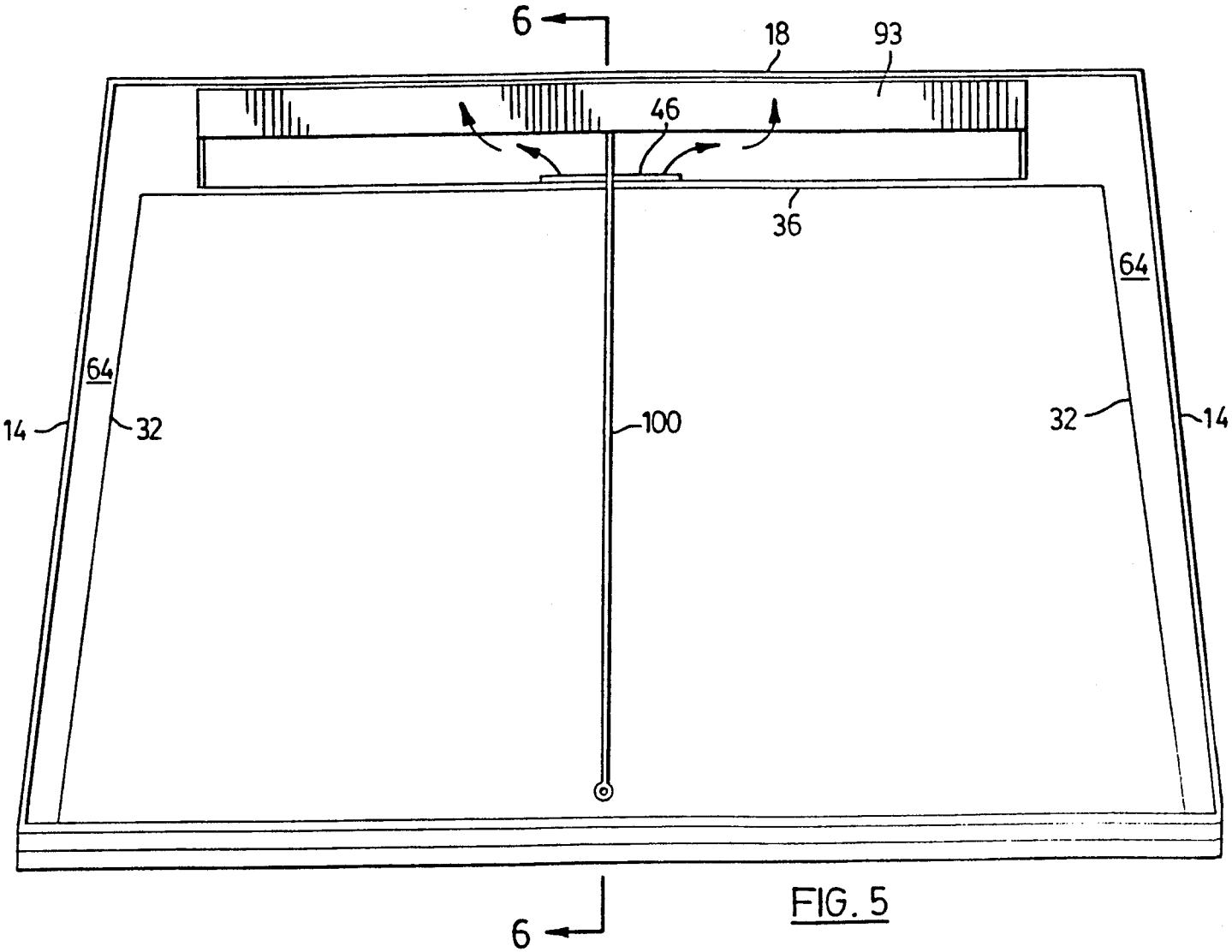
FIG. 5 is a top view, with the top panel of the outer casing removed, of a fireplace according to a second embodiment of the instant invention.

In order to further increase the transfer of heat from the combustion gases to the room air, side room air plenums 64, defined by the space between respective side casing panels and side firebox panels, may be provided (see FIG. 5). With such an arrangement, the room air which enters via port 62 may travel upwardly along the rear panel 36 of the firebox and also upwardly along side panels 32 of the firebox. Upper room air plenum 60 extends across the top of the firebox and is in communication with rear room air plenum 58 and side room air plenums 64. Accordingly, the room air, which passes up rear room air plenum 58 as well as side room air plenums 64, travels through upper room air plenum 62 and exits the fireplace via room air exit port 74. It will be appreciated by those skilled in the art that one or more of the rear or side room air plenums may be blocked by placing insulation therein. For example, insulation may be placed in side room air plenums 64 thus causing all of the room air to circulate up rear room air plenum 58. Alternately, insulation may be placed in rear room air plenum 58 forcing all of the room air to travel up side room air plenums 64.

As shown in the preferred embodiment of FIGS. 3 and 4, heat exchanger 80 may be positioned in upper room air plenum 60. Heat exchanger 80 is positioned in upper room air plenum 60 between top room air panel 68 and top panel 30 of the firebox so as to allow the room air to circulate around heat exchanger 80 as the room air passes through upper room air plenum 60. In one embodiment, heat exchanger 80 may comprise a first plenum 82, a second plenum 84, a generally U-shaped portion 86 connecting the forward end of first plenum 82 with the forward end of second plenum 84, an entrance 88 and an exit 90.

A first passage 92 extends from flue 46 to entrance 88 of heat exchanger 80. A second passage 94 extends from exit 90 of heat exchanger 80 to a dilution hood generally represented by reference numeral 96. A bypass port 98 is positioned adjacent the rear of fireplace 10 and is positioned to provide communication from first passage 92 to second passage 94.

In order to selectively couple and decouple heat exchanger 80 in series with first passage 92 and second passage 94, there is provided a rod 100 having a first door 102 and a second door 104 attached thereto. First door 102 is attached to the rear portion of rod 100. First door 102 is sized and adapted so as to be capable of sealing by-pass port 98 (see FIG. 3). Second door 104 is attached to a forward portion of rod 100. Second door 104 is sized and adapted to be capable of sealing generally U-shaped portion 86 of heat exchanger 80 (see FIG. 4).

Rod 100 is movable from a first position, as shown in FIG. 3, to a second position, as shown in FIG. 4. Rod 100 may be moved from the first position to the second position by means of a handle 106. First door 102 and second door 104 are positioned on rod 100 such that when rod 100 is in the first position, first door 102 seals by-pass port 98 and, when rod 100 is in the second position, second door 104 seals generally U-shaped portion 86. Accordingly, when rod 100 is in the first position, combustion gases exit from the firebox into flue 46 and into first passage 92. The combustion gases then enter first plenum 82 of heat exchanger 80 through entrance 88, flow forwardly through first plenum 82, into generally U-shaped portion 86, then rearwardly through second plenum 84, and exit heat exchanger 80 from exit 90 into second passage 94. The combustion gases then flow from second passage 94 through dilution hood 96 and then through an appropriate conduit, such as a chimney, to the outside. However, when rod 100 is in the second position, heat exchanger 80 is sealed and the combustion gases pass from flue 46 through first passage 92, by-pass port 98 and second passage 94 into dilution hood 96, as is shown in FIG. 4.

By this arrangement, when rod 100 is in the first position, heat exchanger 80 is connected in series such that the combustion gases pass through heat exchanger 80. In this mode, the heat transfer from the combustion gases to the room air circulating through top room air plenum 60 will be maximized. If the temperature of the room in which the fireplace is situated increases too much, then rod 100 may be moved towards the second position, as shown in FIG. 4, so as to allow part of the combustion gases to bypass heat exchanger 80 thus decreasing the amount of heat which will be transferred to the circulating room air. Alternately, rod 100 may be moved completely to the second position, as shown in FIG. 4, so as to minimize the amount of heat which is transferred from the combustion gases to the circulating room air.

As shown in FIGS. 3 and 4, the fireplace may also allow the operator to supplement the room air with fresh air from an external source. In particular, fireplace 10 may include fresh air plenum 110 which is positioned below lower room air plenum 108 and is separated therefrom by bottom casing panel 16. Second by-pass port 114 is provided in bottom casing panel 16 towards the rear of said panel. Second by-pass port 114 permits communication between fresh air plenum 110 and lower room air plenum 108. An entrance, generally designated by reference numeral 118, is provided in the lower portion of fresh air plenum 110. Entrance 118 is in communication with a source of fresh air external to the room in which the fireplace is situated, such as the outside, via conduit 120.

Air lever 122 is operable between a first position as shown in FIG. 3 and a second position as shown in FIG. 4. Air lever 122 has a rear portion 124 which is sized and adapted to seal second by-pass port 114. Air lever 122 may be moved from the first position to the second position by means of handle 128 (not shown). When air lever 122 is in the first position, as shown in FIG. 3, second by-pass port 114 is sealed by rear portion 124. Accordingly, air passes from the room in which the fireplace is situated through entrance 116, through lower room air plenum 108 and into rear air plenum 58.

When air lever 122 is moved to the second position, as shown in FIG. 4, then by-pass port 114 is opened, and the fresh air travels through conduit 120, through entrance 118, through fresh air plenum 110 and into lower room air plenum 108.

Room air plenum 56 is in communication with the interior of the firebox through a plurality of openings 130 in lower panel 34 of the firebox. Accordingly, room air is used for combustion. To ensure proper venting of the fireplace, fresh air may be admitted to the room by moving air lever 122 so that second by-pass port 114 is open. When the second by-pass port 114 is open, fresh air is entrained with the room air entering lower room air plenum 108 via entrance 116. This combined air stream travels through air plenums 58 and 63 and the resultant heated air exits to the room. Accordingly, fresh air is heated prior to being admitted to the room to reduce any negative pressure which may be created by using room air as combustion air in the firebox.

Figure 10:
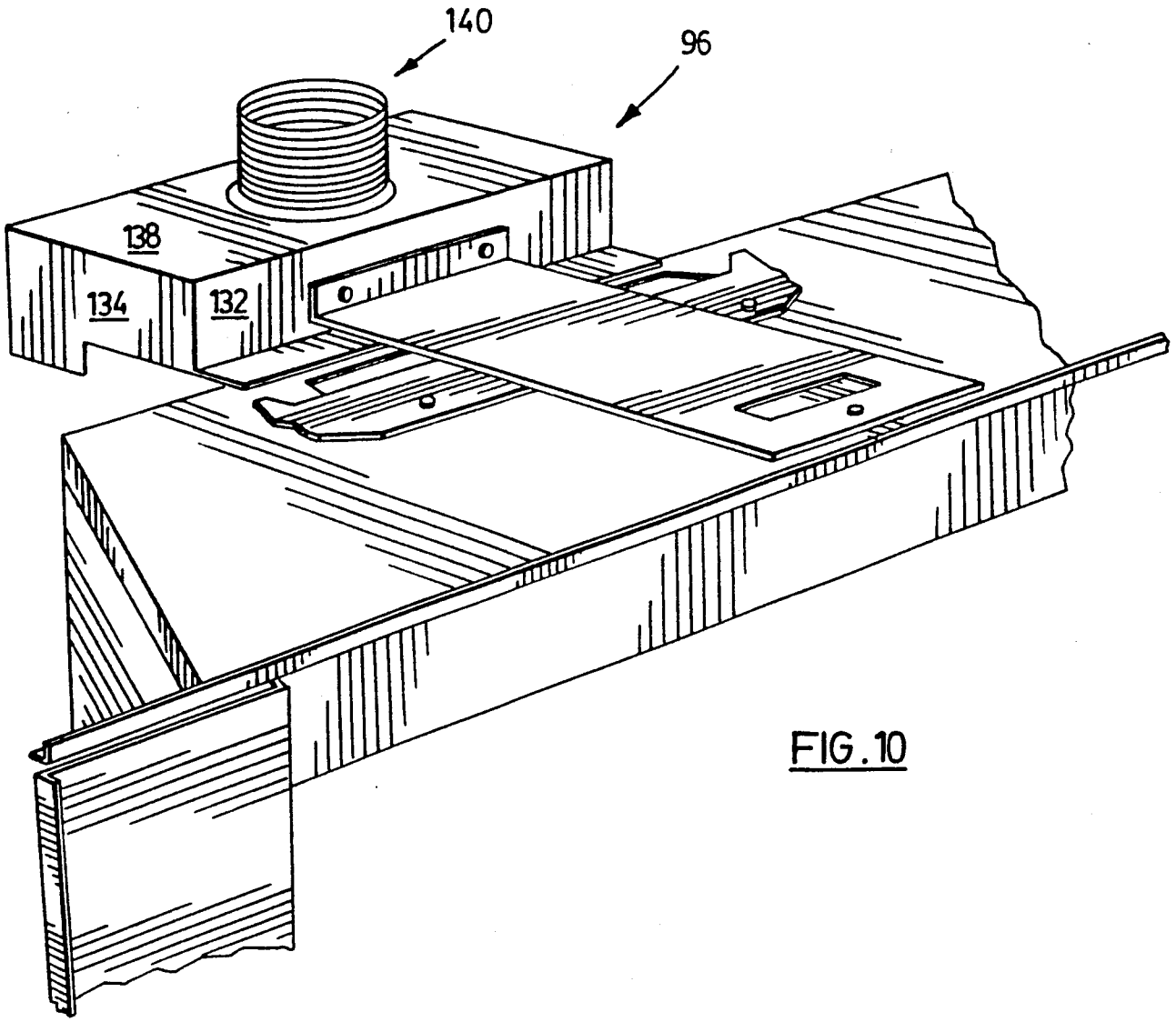

As discussed above, the fireplace may also include dilution hood 96. Dilution hood 96 permits the combustion gases to combine with room air and for the mixture thus formed to be exhausted from the fireplace cavity. As shown in FIGS. 3 and 10, dilution hood 96 comprises front panel 132, side panels 134, rear panel 136, top panel 138 and exhaust conduit 140. Dilution hood 96 is located on the rear portion of fireplace 10 with a portion of the dilution hood extending rearwardly and downwardly therefrom. Dilution hood 96 is positioned above the exit from second passage 94. Accordingly, as the combustion gases exit from second passage 94, they enter dilution hood 96 and pass upwardly through exhaust conduit 140. The rearward portion of dilution hood 96 extends rearwardly behind the fireplace and allows room air, which surrounds the fireplace, to enter the dilution hood and also pass upwardly through exhaust conduit 140. Baffle 142 is provided in dilution hood 96 and extends from a position on top panel 138 downwardly and rearwardly. The bottom of baffle 142 defines a passage 144 between the baffle and the top of the fireplace. Baffle 142 causes the combustion gases to pass to the rear of the dilution hood, where they mix with room air, before extending exhaust conduit 140.

Figure 6:
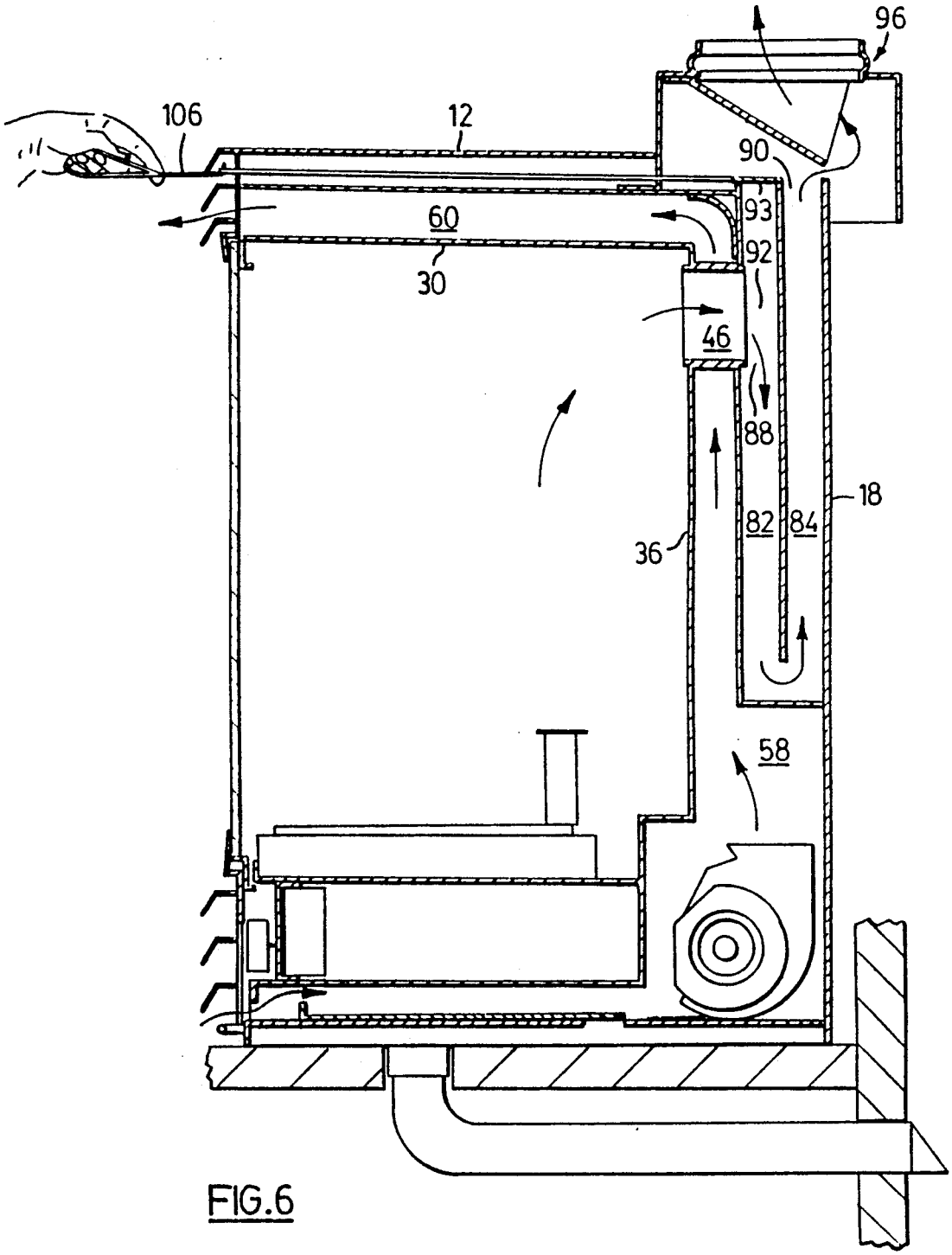
FIG. 6 is a cross-section along the line 6—6 in FIG. 5 with both the by-pass and the fresh air dampers closed.
Figure 7:
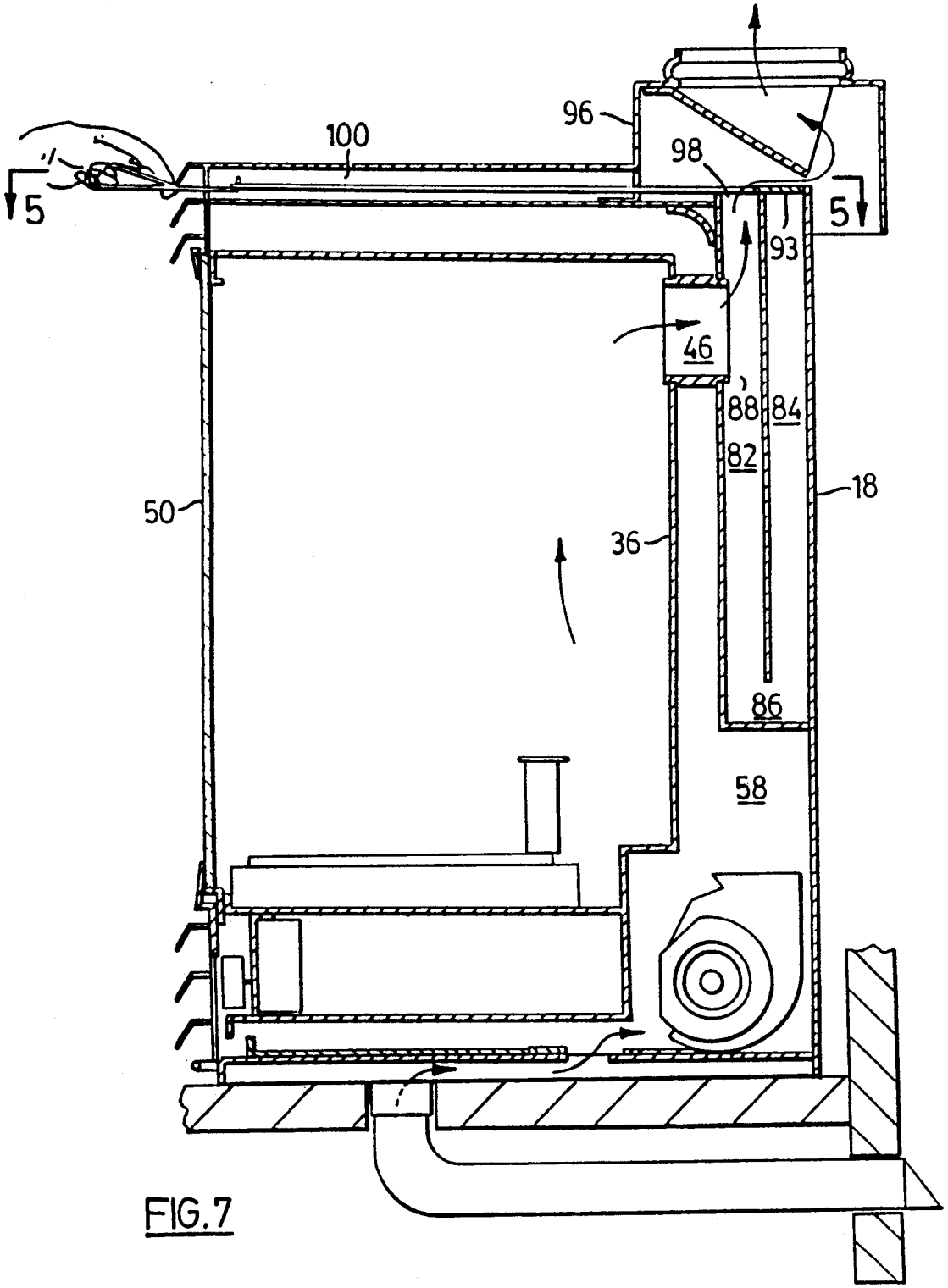
FIG. 7 is a cross-section similar to that of FIG. 6 but with the by-pass and fresh air dampers open.

FIGS. 5, 6 and 7 show an alternative preferred embodiment of the present invention. In this embodiment, the heat exchanger 80 is positioned in rear room air plenum 58 between rear casing panel 18 and rear panel 36 of the firebox. The heat exchanger 80 is positioned in rear room air plenum 58 so as to allow the room air to circulate around the heat exchanger 80 as the room air passes through rear room air plenum 58. As with the embodiment described above, heat exchanger 80 comprises an entrance 88, a first plenum 82, a generally U-shaped portion 86, a second plenum 84 and an exit 90. However, in the embodiment shown in FIGS. 5, 6 and 7, generally U-shaped portion 86 connects the-lower end of first plenum 82 with the lower end of second plenum 84.

The rear vented embodiment of the present invention shown in FIGS. 5, 6 and 7 also includes a rod 100 and a door 93 affixed to the rear portion of rod 100. Preferably, rod 100 is located in upper room air plenum 60. Door 93 is sized and adapted so as to be capable of sealing alternately by-pass port 98 and exit 90.

Rod 100 is movable from a first position, as shown in FIG. 6, to a second position as shown in FIG. 7. When in said first position, door 93 seals by-pass port 98. Accordingly, the combustion gases exit from the firebox into flue 46 and into first passage 92. The combustion gases then enter first plenum 82 of heat exchanger 80 through entrance 88, flow downwardly through first plenum 82 into generally U-shaped portion 86, then upwardly through second plenum 84, and exit heat exchanger 80 from exit 90. The combustion gases then flow through dilution hood 96 and then through a conduit, such as a chimney, to the outside. When rod 100 is in the second position, as shown in FIG. 7, door 93 seals exit 90. Accordingly, when rod 100 is in the second position, the combustion gases exit from the firebox into flue 46, into by-pass port 98 and then into dilution hood 96.

Rod 100 may be moved from the first position to the second position by means of a handle 106. When rod 100 is in the first position, heat exchanger 80 is connected in series such that combustion gases pass through heat exchanger 80. When rod 100 is in the second position, heat exchanger 80 is decoupled and the combustion gases do not flow therethrough.

Figure 8:
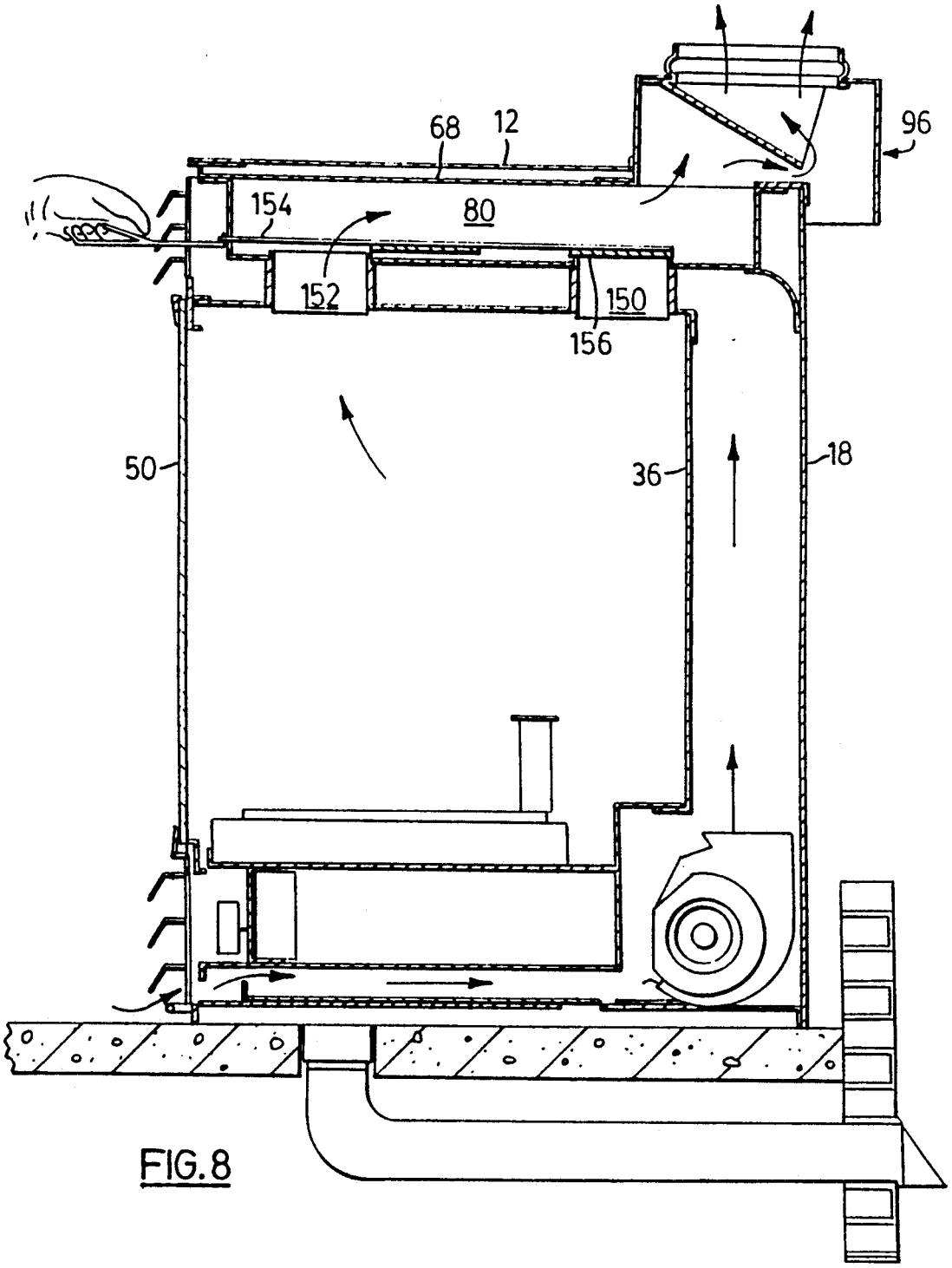
FIG. 8 is a cross-section along the line 3—3 in FIG. 1 of a third embodiment of the instant invention, with the by-pass and the fresh air dampers closed.
Figure 9:
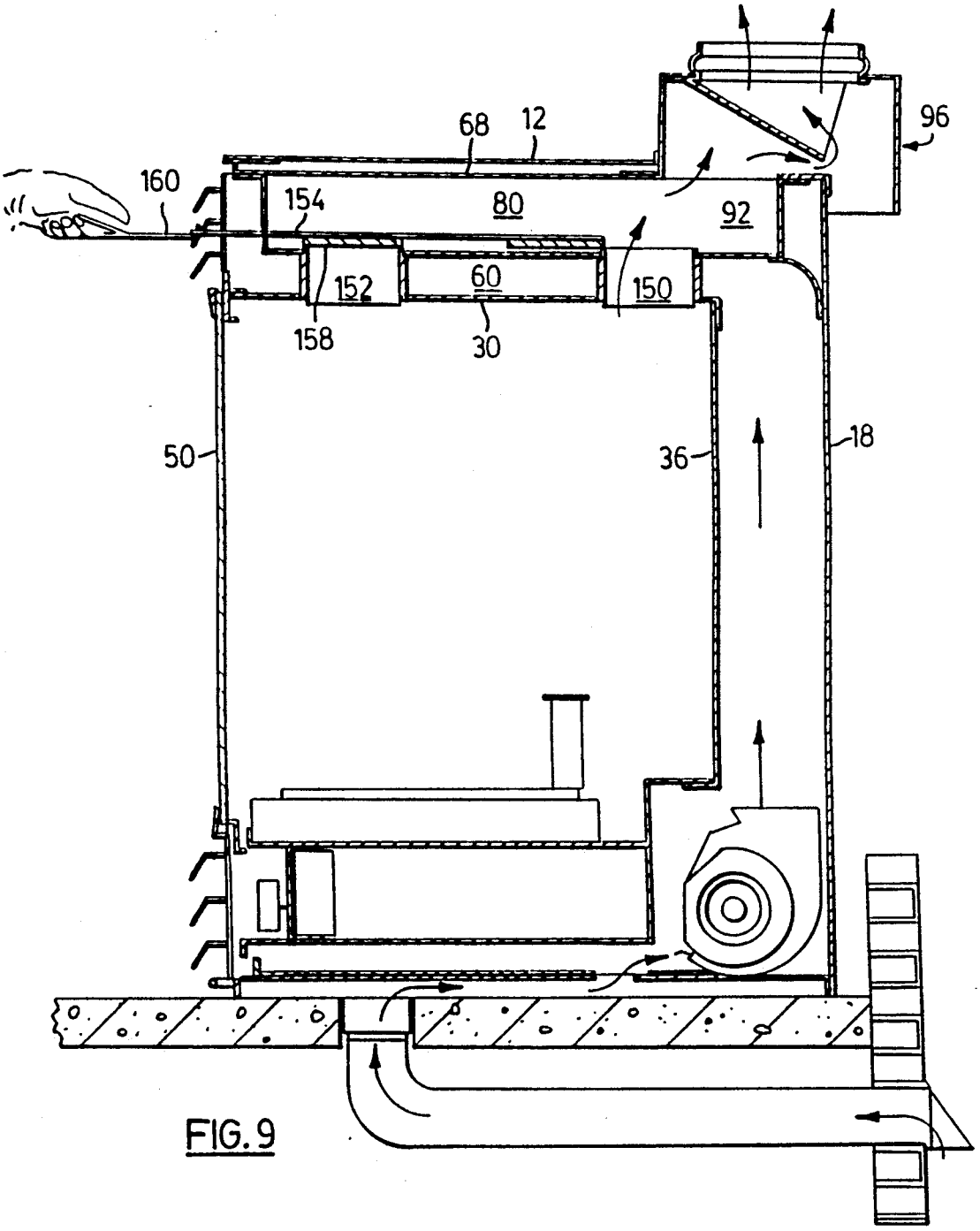
FIG. 9 is a cross-section similar to that of FIG. 8 but with the by-pass and fresh air dampers open; and, FIG. 10 is a partially exploded, top perspective view of the fireplace.

A further embodiment of the present invention is illustrated in FIGS. 8 and 9. In this embodiment, the heat exchanger 80 is a single pass heat exchanger. As in the first preferred embodiment described above, heat exchanger 80 is positioned in upper room air plenum 60. A first flue passage 150 is provided proximate the rear panel 36 of the firebox and a second flue passage 152 is provided proximate the front of the firebox.

In order to selectively couple heat exchanger 80 with first passage 92, rod 154, first door 156 and second door 158 are provided. Rod 154 is positioned in heat exchanger 80. First door 156 is attached to the rear portion of rod 154 and second door 158 is attached to the forward portion of rod 154. First door 156 is sized and adapted so as to be capable of sealing first flue passage 150. Second door 158 is sized and adapted so as to be capable of sealing second flue passage 152.

Rod 154 is movable from a first position, as shown in FIG. 8, to a second position, as shown in FIG. 9. First door 156 and second door 158 are positioned on rod 154 such that when rod 154 is in the first position, first door 156 seals first flue passage 150 and second flue passage 152 is open and, when rod 154 is in the second position, second door 154 seals second flue passage 152 and first flue passage 150 is open.

Accordingly, when rod 154 is in the first position, the combustion gases exit the firebox through second flue passage 152, pass through heat exchanger 80 into first passage 92 and exit into dilution hood 96. However, when rod 154 is in the second position, combustion gases exit the firebox through first flue passage 150 and pass into dilution hood 96, by-passing heat exchanger 80. Rod 154 is movable between the first position and the second position by means of a handle 160, which is releasably attachable to rod 154.

We claim:

1. A fireplace comprising:

(a) a firebox having a bottom panel, a top panel, a rear panel and a flue;

(b) an outer casing having a top panel and a rear panel, said casing being spaced from and surrounding said firebox;

(c) combustion air feed means for supplying combustion air to said firebox;

(d) a heat exchanger located downstream from said flue for selectively receiving combustion gases and for transmitting the heat from said combustion gases to air to be heated;

(e) first passage means for conveying said combustion gases from said flue to a conduit means in communication with a source external to the room in which the fireplace is situated for exhausting the combustion gases from the fireplace, said first passage means including a first passage located downstream from said flue for conveying said combustion gases from said flue to said heat exchanger and a second passage located downstream from said heat exchanger for conveying said combustion gases from said heat exchanger to conduit means in communication with a source external to the room in which the fireplace is situated for exhausting the combustion gases from the fireplace, when said switching means is in said first position, said combustion gases pass through said first passage, said heat exchanger and said second passage before being vented to the outside, and when said switching means is in said second position, said combustion gases pass through said first and said second passage, by-passing said heat exchanger, and are vented to the outside;

(f) second passage means positioned between said outer casing and said firebox for circulation of said air to be heated along said heat exchanger; and, (g) switching means for selectively coupling said heat exchanger in series with said first passage means, said switching means being operable between a first position in which said combustion gases pass through said heat exchanger before being vented to the outside and a second position in which said combustion gases pass through said first passage means, by-passing said heat exchanger, and are vented to the outside.

2. The fireplace of claim 1 wherein said heat exchanger is at least a double pass heat exchanger having an entrance and an exit, said entrance to said heat exchanger being in communication with said first passage and said exit from said heat exchanger being in communication with said second passage, said heat exchanger having a first plenum extending from said first passage and a second plenum extending to said second passage, said first and said second plenums being in communication through a generally U-shaped portion.

3. The fireplace of claim 2 wherein said heat exchanger is positioned between said top panel of said outer casing and said top panel of said firebox.

4. The fireplace of claim 3 wherein said second passage is proximate to said flue and said first passage means includes a by-pass port connecting said first and second passages, and said switching means comprises a first door operable between a first position in which said by-pass port is closed and a second position in which said by-pass port is open and a second door positioned in said heat exchanger and operable between a first open position in which said combustion gases may freely pass through said heat exchanger and a second closed position in which the passage of said combustion gases through said heat exchanger is blocked, such that when said first door is open and said second door is closed the combustion gases pass from said flue, through said first passage, through said by-pass port and into said second passage and when said first door is closed and said second door is open, said combustion gases pass from said flue, through said first passage, through heat exchanger and into said second passage.

5. The fireplace of claim 4 wherein said first and second doors are affixed to a rod having a handle means releasably attachable to one end thereof, said rod being positioned in said second plenum of said heat exchanger and operable by said handle means between a first position in which said by-pass port is closed and said generally U-shaped portion is open and a second position in which said by-pass port is open and said generally U-shaped portion is closed.

6. The fireplace of claim 2 wherein said heat exchanger is positioned between said rear panel of said outer casing and said rear panel of said firebox.

7. The fireplace of claim 6 wherein said first passage means comprises a first passage located downstream from said flue for conveying said combustion gases from said flue to said heat exchanger and a second passage located downstream from said heat exchanger for conveying said combustion gases from said heat exchanger to conduit means in communication with a source external to the room in which the fireplace is situated for exhausting the combustion gases from the fireplace wherein, when said switching means is in said first position, said combustion gases pass through said first passage, said heat exchanger and said second passage before being vented to the outside, and when said switching means is in said second position, said combustion gases pass through said first passage, by-passing said heat exchanger, and are vented to the outside.

8. The fireplace of claim 7 wherein said heat exchanger is at least a double pass heat exchanger having an entrance and an exit, said entrance to said heat exchanger being in communication with said first passage and said exit from said heat exchanger being in communication with said second passage, said heat exchanger having a first plenum extending from said first passage and a second plenum extending to said second passage, said first and said second plenums being in communication through a generally U-shaped portion.

9. The fireplace of claim 8 wherein said switching means comprises a door operable between a first position in which said combustion gases pass from said flue, through said heat exchanger and exit to said conduit means and a second position in which said combustion gases pass from said flue, into said first passage and exit to said conduit means, by-passing said heat exchanger.

10. The fireplace of claim 9 wherein said door is affixed to a rod having a handle means releasably attachable to one end thereof, said rod being above said top panel of said firebox and operable by said handle means between a first position in which said door is in said first position and a second position in which said door is in said second position.

11. The fireplace of claim 1 wherein said flue comprises first and second flue passages in said top panel of said firebox, said first flue passage being proximate said rear panel of said firebox and said second flue passage being proximate the front of said firebox, said heat exchanger extending from said first flue passage to said second flue passage.

12. The fireplace of claim 11 wherein said switching means comprises first and second doors operable between a first position in which said first flue passage is closed and said second flue passage is open and a second position in which said first flue passage is open and said second flue passage is closed, such that when said first and second doors are each in said first position, the combustion gases pass from said firebox into said second flue passage, through said heat exchanger and into said conduit means, and when said first and second doors are each in said second position, the combustion gases pass from said firebox into said first flue passage and into said conduit means, by-passing said heat exchanger.

13. The fireplace of claim 12 wherein said first and second doors are affixed to a rod having a handle means releasably attachable to one end thereof, said rod being operable by said handle means to position said first and second doors in said first position and said second position.

14. The fireplace of claim 1 wherein said fireplace further comprises a fresh air conduit adapted to be connected to a source external to the room in which the fireplace is situated for supplying fresh air to said second passage means and second switching means for alternately opening and closing said fresh air conduit.

15. The fireplace of claim 14 wherein said combustion air feed means comprises a combustion air port in communication with said firebox and a room air plenum in communication with the room in which said fireplace is situated for supplying room air as combustion air to said fireplace via said combustion air port, said second passage means comprises a lower room air plenum positioned below said fireplace, a rear room air plenum positioned behind said firebox and a top room air plenum positioned above said firebox and said second switching means is operable between a first position in which room air passes from said room into said lower room air plenum, said rear room air plenum and said top room air plenum before exiting to said room and a second position in which air passes from said external source into said lower room air plenum to supplement said room air travelling through said lower room air plenum.

16. The fireplace of claim 15 wherein said lower room air plenum has a fresh air port which is in communication with said fresh air conduit and a door which is positioned and adapted to seal said fresh air port and which is operable between an open position and a closed position.

17. The fireplace of claim 17 wherein said door is affixed to a rod having a handle means releasably attachable to one end thereof, said rod being operable by means of said handle means to open and close said door.

18. The fireplace of claim 1 wherein said fireplace is adapted to be inserted into a fireplace enclosure and further comprises a dilution hood, said dilution hood having an entrance in communication with said second passage means and adapted to be in communication with said enclosure such that, when said fireplace is in operation, room air in said enclosure combines with said combustion gases in said dilution hood and said combined combustion gases and room air are exhausted to said external source.

19. The fireplace of claim 18 wherein said dilution hood has a first portion and a second portion and, when said fireplace is installed in said enclosure and said dilution hood is installed on said fireplace, said first portion is positioned on top of said top panel of said outer casing and said second portion extends rearwardly behind said fireplace, said first portion is in communication with said first passage means and said second portion is in communication with said enclosure.

20. The fireplace of claim 19 wherein said dilution hood includes baffle means for causing said combustion gases and said room air to at least partially mix prior to being exhausted.

* * * * *